US005238502A

United States Patent [19]

Jenkins

[11] Patent Number: 5,238,502

[45] Date of Patent: Aug. 24, 1993

[54] CONDENSER BACKFLUSH SYSTEM AND METHOD FOR USE

[76] Inventor: Jerry Y. Jenkins, 583 Parlange Loop, La Place, La. 70068

[21] Appl. No.: 824,170

[22] Filed: Jan. 22, 1992

[51] Int. Cl.[5] ..... B08B 9/02; F28G 3/00

[52] U.S. Cl. ..... 134/22.11; 134/23; 134/24; 134/34; 134/37; 134/172; 165/95

[58] Field of Search ..... 134/22.1, 22.11, 22.12, 134/22.18, 23, 24, 34, 37, 172, 180, 181; 122/379, 396; 165/95

[56] References Cited

U.S. PATENT DOCUMENTS

| | | | |
|---|---|---|---|
| 1,589,980 | 6/1926 | Miller et al. | 165/95 |
| 3,242,872 | 3/1966 | Thompson | 210/391 |
| 3,903,912 | 9/1975 | Ice, Jr. et al. | 134/172 X |
| 4,169,792 | 10/1979 | Dovel | 210/793 |
| 4,234,993 | 11/1980 | Kintner | 165/95 |
| 4,269,264 | 5/1981 | Goeldner | 134/22.12 X |
| 4,447,323 | 5/1984 | Jackson | 210/158 |
| 4,531,571 | 7/1985 | Moss | 165/95 X |
| 4,542,785 | 9/1985 | Bagnall et al. | 165/95 |
| 5,060,600 | 10/1991 | Brown et al. | 134/22.11 X |

*Primary Examiner*—Theodore Morris
*Assistant Examiner*—Saeed T. Chaudhry
*Attorney, Agent, or Firm*—Keck, Mahin & Cate

[57] ABSTRACT

A continuous condenser backflush system includes a hollow wand attached perpendicularly to a hollow shaft. The wand is rotated in angular increments around the condenser face. The wand is retracted from the condenser face for rotation to a new angular orientation before being reextended to the condenser face to collect and dispose of the trash caught under the wand. Trash caught on the condenser face is flushed by a stream of water back through the shaft to a mesh basket where it is separated from the water. A pump may be provided on the shaft for injecting and circulating cleaning fluids through the condenser. The pump may also pump dehumidified air through the system to keep the condenser dry when the cooling water circulating pump is shut down. A method of using the system is described.

25 Claims, 3 Drawing Sheets

CONDENSER BACKFLUSH SYSTEM AND METHOD FOR USE

This invention relates to a continuous condenser backflush system and method for clearing accumulated trash from the face of a condenser.

BACKGROUND OF THE INVENTION

Known systems do not clean the face of a condenser continuously. Such systems include that of Miller, U.S. Pat. No. 1,589,980, directed to a washer which directs a stream of water, under pressure, between the condenser tubes. The washer travels in a circle and all the tubes in the circumference of such circle are washed consecutively.

Thompson, U.S. Pat. No. 3,242,872, describes water supply inlet structures including self-cleaning screens. A cylindrical revolving screen is described, including jet cleaning means positioned inside the revolving screen. Kintner, U.S. Pat. No. 4,234,993, describes a system for cleaning the tubes of a condenser or other heat exchanging unit by circulating sponge balls therethrough using a circulating pump. A screen assembly includes four vertical screens about 90° apart. By turning the screens through 180°, the screens are completely flushed of debris without the need to remove the balls or to stop circulation of the balls during the screen cleaning operation.

Jackson, U.S. Pat. No. 4,447,323, describes a trash rake for cleaning the bars of a water intake bar screen. Dovel, U.S. Pat. No. 4,169,792, discloses a water intake device comprising a substantially cylindrical rotatable screen adapted to be at least partially submerged in a body of water. The screen is rotated and a water supply conduit communicating with the interior of the screen receives water flowing through the screen. Means for backflushing a section of the screen as the screen moves so as to clear or remove objects or fish caught on the exterior surface of the screen is described. Bagnall et al., U.S. Pat. No. 4,542,785, describes a cleaner for an agricultural harvester cooling system.

None of these known methods satisfactorily allows for continuous backflushing of a condenser, as described herein.

SUMMARY OF THE INVENTION

A continuous condenser backflush system of the invention includes a hollow wand for removing trash from a face of a condenser cooled with a stream of water, such as river water, a hollow shaft attached to the hollow wand for conveying the trash to a remote location, thrusting gears for extending the wand to adjacent the condenser face and retracting it therefrom and rotating gears for angularly rotating the wand. Valves are provided for opening when the wand is extended adjacent the condenser face to allow trash on the condenser face to be carried by a stream of water to a remote location and for closing before moving the wand to a different angular position. After the trash under the face of the wand is conveyed to a remote location in the stream of water, the valve is closed, the wand retracted from the condenser face and rotated to a different angle before being extended to the condenser face again in a different position for removing the trash from the condenser face at the different position. Automatic controls allow the condenser face to be cleaned continuously.

Manual or automatic controls enable successively positioning the wand adjacent the condenser face, opening the valve, closing the valve, retracting the wand, rotating the wand and extending the wand to adjacent the condenser face again in a different angular position. Automatic controls allow the condenser face to be cleaned continuously.

The rotating mechanism includes a disengaging mechanism, a mechanism for setting an angle of rotation and a mechanism for re-engaging the rotation mechanism. The wand is generally rotated in increments of about 5° to 15°, preferably in increments of about 9° to 11° and most preferably in increments of about 10°. The thrusting mechanism extends and retracts the wand about 3" to 8", preferably about 4" to 6" and most preferably about 5", between each rotation.

The wand is an elongated, hollow semi-cylindrical member, closed at each end. A hollow shaft, such as a hollow pipe is connected perpendicularly to a mid-point of the hollow wand.

A method for cleaning trash from a face of a condenser cooled with a stream of water, using the apparatus described, includes: (a) providing a hollow wand having an elongated open face in a first position adjacent the condenser face in fluid connection with a hollow shaft attached to the wand; (b) opening an outlet valve of the shaft for enabling trash adhering to the condenser face to pass in a stream of cooling water from adjacent the condenser face through the hollow wand and through the hollow shaft to a remote location; (c) retracting the wand from adjacent the condenser face; (d) angularly rotating the wand; (e) extending the wand to a second position angularly rotated from the first position adjacent the condenser face, and (f) repeating steps (a), (b), (c), (d) and (e) in continuous succession for a period of time. The wand is thus continuously rotated around the condenser face and segments of the condenser face are successively cleaned of trash. The outlet valve is closed before retracting the wand. The rotating step includes disengaging the rotation mechanism, resetting the rotation mechanism, and reengaging the rotation mechanism.

The trash is separated from the stream of water carrying the trash at a remote location.

It is an object of the invention to provide a substantially continuous backflush system for cleaning the face of a condenser which is cooled by water which may include trash or other debris.

It is another object of the invention to provide a method for using the continuous backflush system described.

DETAILED DESCRIPTION OF THE INVENTION

A condenser backflush system of the invention advantageously used for cleaning a condenser cooled by river water, or other water which may carry trash with it, has the advantage of operating continuously, without needing to close down the system for cleaning the condenser face. Water-borne trash unfortunately collects continuously on the condenser face. If the trash is not removed from the condenser face, the efficiency of the condenser is seriously impaired as the water flow reaching the tubes to provide the necessary cooling may be substantially reduced and inefficient, inadequate cooling may result. The method and apparatus described herein solves the long standing problem of continuous cleaning of the condenser face. This system is used, for example, in power plants and other installations where water from natural sources, such as river water which may carry trash, is used for cooling the condensers.

Figure 1:
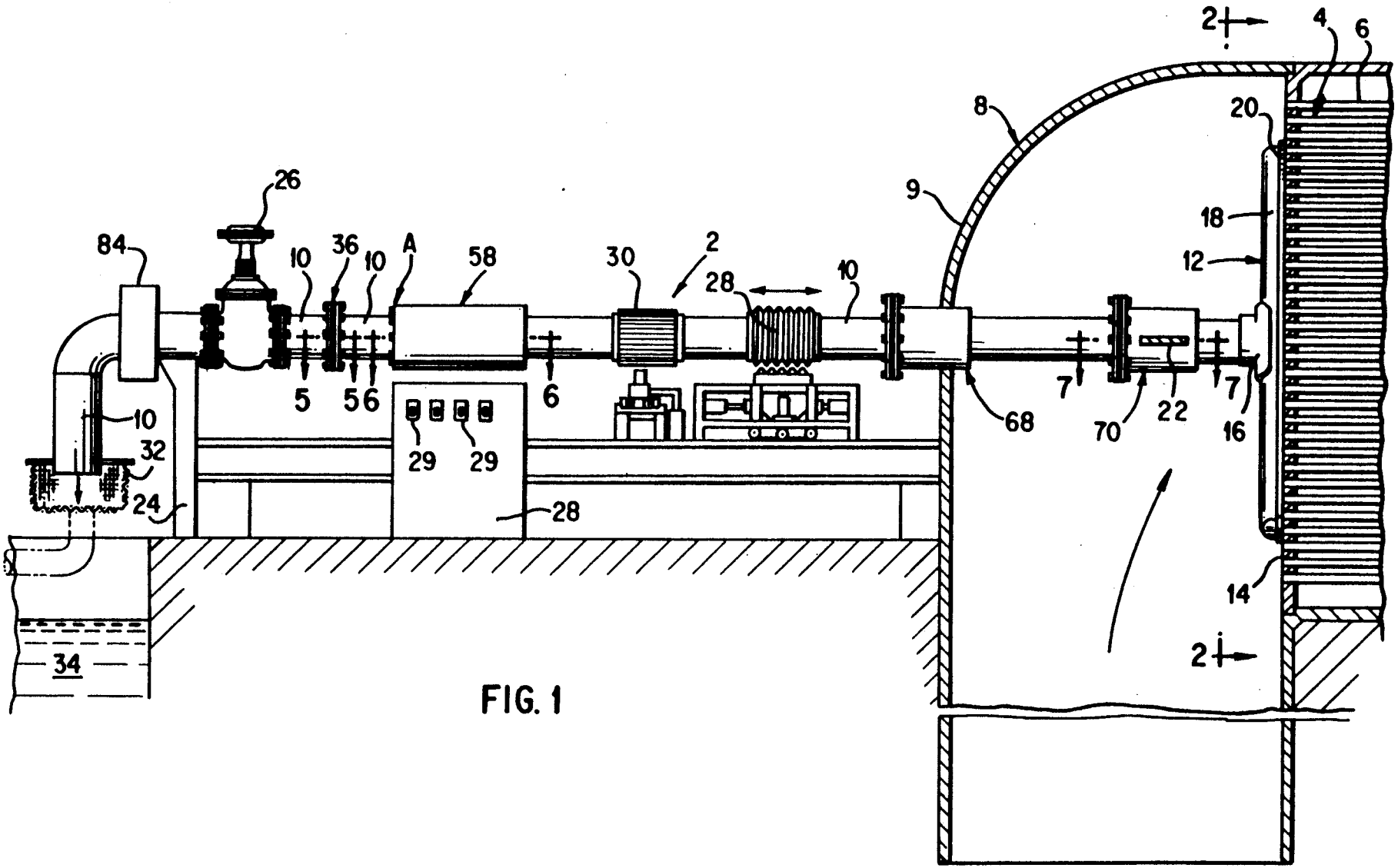
FIG. 1 is a schematic side elevational view of a condenser backflush system of the invention.
Figure 2:
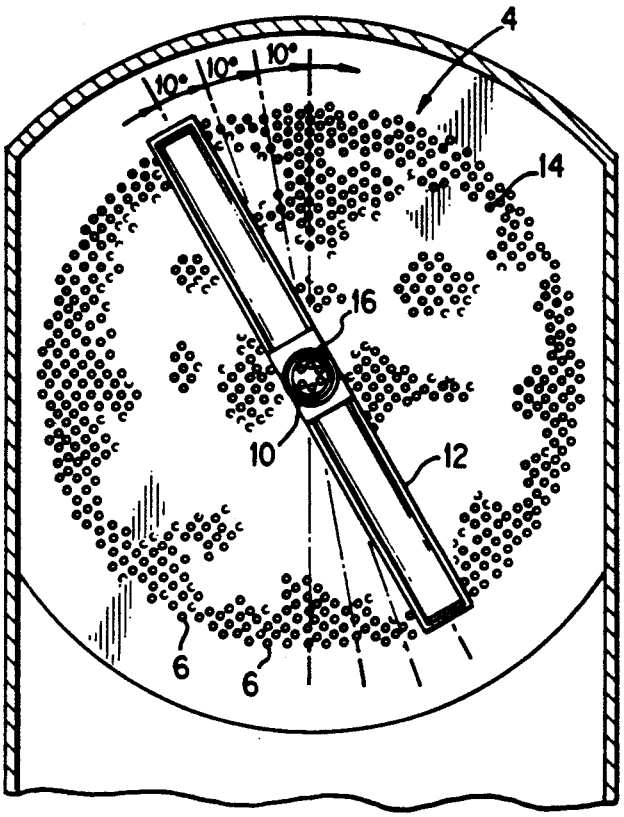
FIG. 2 is a cross-sectional view taken on line 2—2 of FIG. 1.
Figure 3:
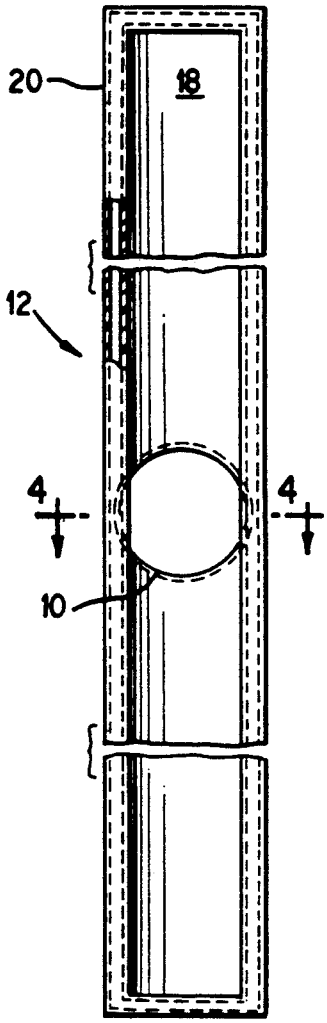
FIG. 3 is an end view of a backflush wand of the invention.

With reference to FIGS. 1 to 7, in which like numerals represent like elements. FIG. 1 illustrates a system 2 according to the invention. Condenser 4 which includes a plurality of condenser tubes 6 is contained in a housing 8. Hollow shaft 10 enters housing 8. Wand 12, attached substantially perpendicularly to hollow shaft 10, is positioned against condenser face 14 for removing trash. Wand 12 extends across the diameter of the condenser face, covering the ends of the condenser tubes from side to side of the condenser face, as shown in FIGS. 1 and 2. Shaft 10, which may be a hollow iron pipe is attached to wand 12 perpendicularly at joint 16. Wand 12, in non-limiting example, as shown in FIGS. 1 to 3, may be a half-section of an elongated pipe 18 having a rubber edge facing 20 for providing close contact to condenser face 14. Wand 12 may have other shapes or configurations. For example, the side edges of wand 12 may flare slightly outward from the center toward the circumference of the condenser face so that, for a substantially circular condenser face, the wand is shaped to cover two diametrically opposed sectors of the circle with the hollow shaft 10 entering the wand at the center.

Shaft 10 is supported in horizontal orientation by wall 9 of housing 8, by support 22 which extends to wall 9 of housing 8 and by support 24. Other supports may be used along the length of shaft 10, as appropriate.

FIG. 2 illustrates a typical face 14 of condenser 4. Condenser face 14 includes a plurality of individual condenser tubes 6. Wand 12 rests against condenser face 14 at a selected angular position. Shaft 10 enters wand 12 at substantially a mid-point thereof and is secured to wand 12 by collar 16. Wand 12 is moved around the face of the condenser in angular increments of about 5° to 15°, preferably about 9° to 11° increments. A 10° angular increment is preferred. In a typical 360° rotation of wand 12, 90% or more of the condenser face is covered by the wand and cleaned. The incremental angle can be chosen so that in each rotation the wand covers an area not completely covered by the previous rotation of the wand. Alternatively, the wand is shaped so that there is complete coverage of the condenser face in a 360° rotation of the wand.

Figure 4:
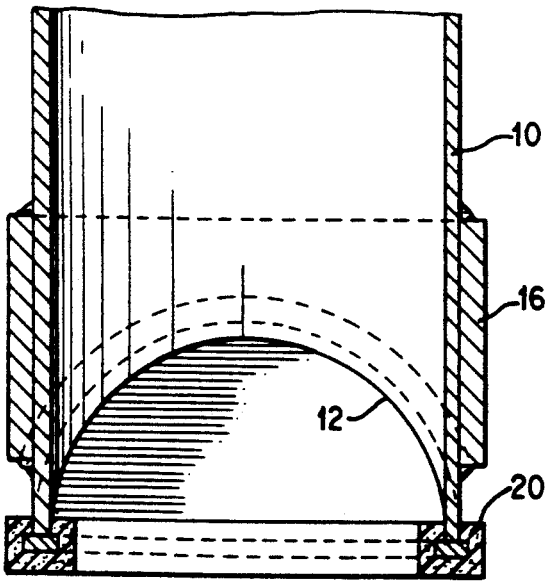
FIG. 4 is a cross-sectional view taken on line 4—4 of FIG. 3.

FIGS. 3 and 4 illustrate the wand and shaft connection, in detail. Wand 12 is preferably made of a section of cylindrical iron pipe, such as 8 inch diameter iron pipe, cut longitudinally to form a half-cylinder and closed at both ends. The cut edge of pipe 18 is covered with a rubber facing 20 for providing a close fit against the condenser tubes. Hollow shaft 10, which may be an 8 inch diameter iron pipe, enters wand 12 substantially at a mid-point thereof. In FIG. 4, the arrangement of shaft 10 perpendicularly to wand 12, secured by collar 16, is shown. Collar 16 is welded between shaft 10 and wand 12. Other arrangements of shaft 10 with respect to wand 12 will be apparent to one skilled in the art.

FIG. 1 shows a system useful for practicing the method of the invention. Valve 26 controls the flow of water through the system and allows for complete shutdown if necessary. Valve 26, including any associated valves for controlling the fluid flow through shaft 10, may be a diaphragm valve, piston valve, gate valve, gate valve with piston or other valve known in the art for accomplishing the described function of valve 26.

Control panel 28 includes a plurality of switches 29 for operating the system, including operation of valve 26. Control panel 28 (including switches 29) may be remotely located for convenience. Switches 29 provide activation of each step of the process. Automation of the control system is within the scope of the invention.

With reference to FIG. 1, which shows the operation of the apparatus, schematically, switches 29 are used to initiate preparation of each stage of the backflush operation. Starting from the position shown in FIG. 1, in which the wand 12 rests against condenser face 14 at the end of a cycle of removing trash from the condenser, switches 29 are activated, either manually or automatically, to operate each stage of the cycle, as follows. Valve 26 is closed and wand 12 is retracted from adjacent condenser face 14. Hollow shaft 10 moves rearward by operation of thrusting gear 28, thus retracting wand 12 from condenser face 14. The rotation gear is disengaged and reset for rotating the wand through an increment of, for example, 10°. Other rotational increments, preferably between about 5° to 15°, may be used. Rotation mechanism 30 is reengaged and wand 12 is rotated through the selected angle, for example, 10°, the rotation mechanism is disengaged and the extending mechanism 28 is engaged. Extending mechanism 28 enables wand 12 to move forward about 3 to 8 inches, preferably about 5 inches, to rest against the condenser face. Valve 26, which may be a diaphragm valve, piston valve, gate valve or other valve known in the art is opened to allow water and trash to flow from the area of the condenser face covered by wand 12 rearward through shaft 10 to outlet basket 32. Outlet basket 32 is a wire mesh basket which holds the trash while the water carrying the trash passes through basket 32 into pond 34 or is otherwise carried away. When the trash underlying wand 12 has been removed, valve 26 is again closed and wand 12 is again retracted from the face of the condenser and the cycle repeated.

Figure 5:
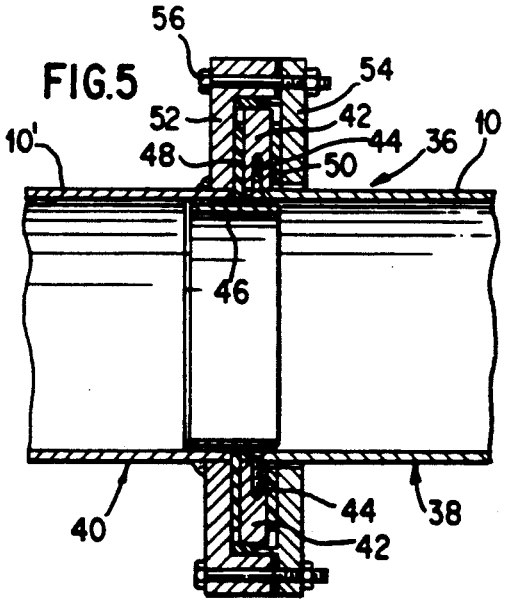
FIG. 5 is a cross-sectional view taken on line 5—5 of FIG. 1.

FIG. 5 illustrates labyrinth seal 36 which forms the joint between rotating section 38 and stationary section 40 of shaft 10. Rotating section 38 includes removable flange 42 secured by a plurality of bolts 44. Stationary section 40 includes hollow shaft 10' to which shield 46 is welded. Teflon rings 48 and 50 are inserted between welded packing ring 52 and removable flange 42 and between removable packing ring 54 and removable flange 42, respectively. Bolt 56 holds packing rings 52 and 54 together. Alternatively, the joint at this location may be a slip or telescope joint, as known in the art.

Figure 6:
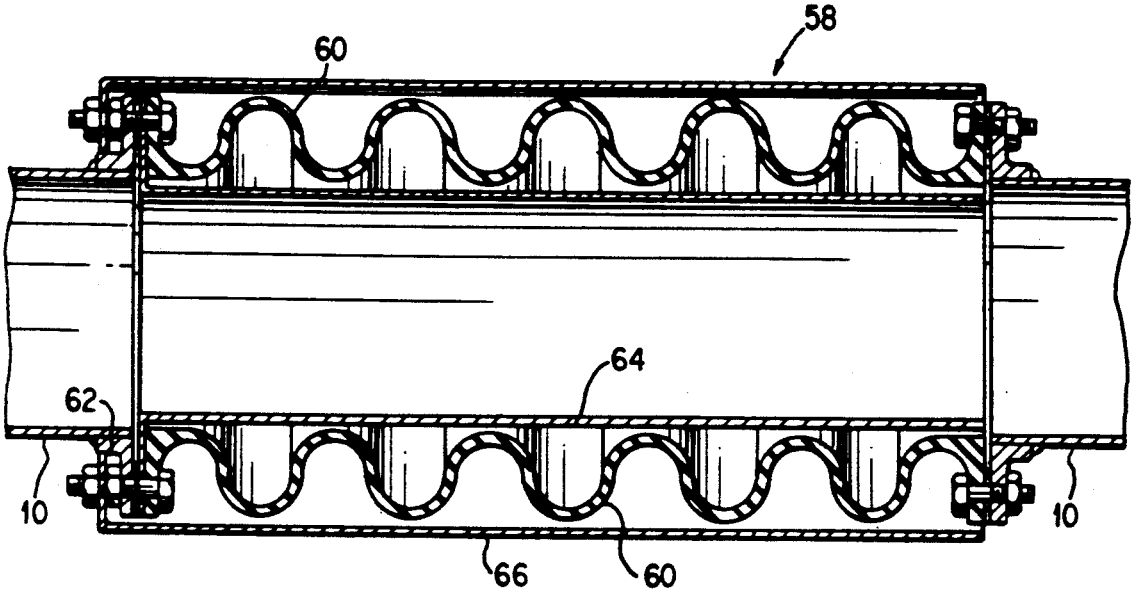
FIG. 6 is a cross-sectional view taken on line 6—6 of FIG. 1.

FIG. 6 illustrates expansion joint 58, which allows for up to about 8" of movement. The expansion joint may extend up to about 30" in length. Rubber expansion joint 60 extends through the expansion joint assembly 58 and is bolted at each end to slip-on flange 62 engaged on shaft 10. Sheet metal inner shield 64 and sheet metal outer shield 66 are engaged with the rubber expansion joint assembly. A slip or telescoping joint may be used in place of expansion joint assembly 58.

Rotation gear 30 for incrementally rotating wand 12 and thrust gear 28 for injecting and retracting wand 12 are known in the art. Can bearing 68 is similar to can bearing 70, shown in more detail in FIG. 7.

Figure 7:
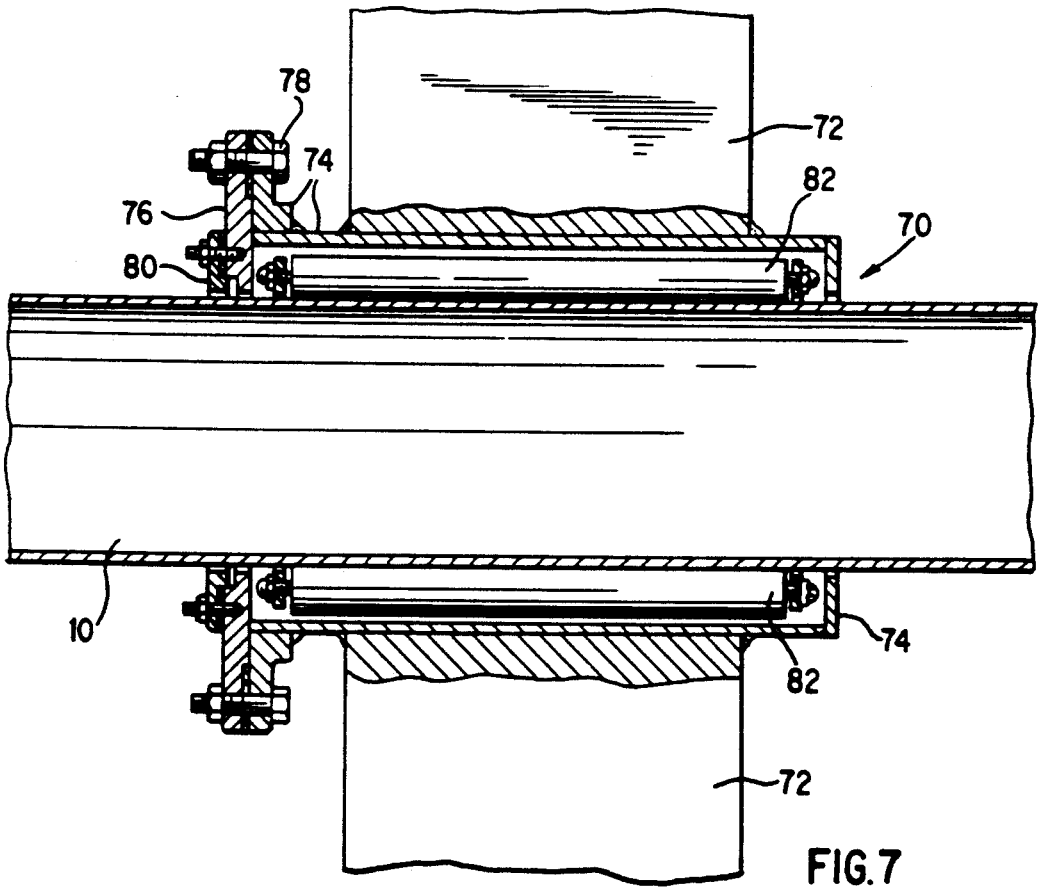
FIG. 7 is a cross-sectional view taken on line 7—7 of FIG. 1.

FIG. 7 illustrates can bearing 70 which is supported on condenser housing 8 by supports 72. Bearing housing 74 is secured to end flange 76 by bolts 78. Packing ring 80 is used on the outside of the can bearings. Roller bearings 82 are located in bearing housing 74 around shaft 10. Instead of roller bearings 82, a plurality of sets of balls and races, such as, for example, 18 sets of balls and races, may be used.

The section of shaft 10 from the condenser face (including wand 12) to the rear end (A) of the expansion joint 58, both thrusts and rotates in operation. The section of shaft 10 between A and labyrinth seal 36 rotates only and the section of shaft 10 from labyrinth seal 36 to wastebasket 32 is stationary.

In a method for cleaning trash from a face of a condenser which is cooled with a stream of water, using the apparatus described above, the method includes positioning a hollow wand having an elongated open face in a first position adjacent the condenser face. The wand is in fluid connection with a hollow shaft attached perpendicularly to the wand. An outlet valve of the shaft is opened to enable trash adhering to the condenser face to pass in a stream of cooling water from adjacent the condenser face back through the hollow wand and through the hollow shaft to a remote location. The wand is retracted from adjacent the condenser face when the trash has been removed. The rotating mechanism is then used to angularly rotate the wand by an increment of 5° to 15°, preferably about 9° to 11°, and more preferably about 10°, to its next position. The wand is then extended to the condenser face in this new position, angularly rotated from the previous position. These steps are repeated in succession for continuously cleaning the condenser face. As the wand is rotated around the condenser face, segments of the face are successively cleaned of trash.

The outlet valve is closed before retracting the wand for rotation. The rotating step includes disengaging the rotation mechanism, resetting the rotation mechanism and reengaging the rotation mechanism at a different angular position. In a typical non-limiting example of operation of the system, the wand is rotated in angular increments of 10° and thrust 5 inches forward against the condenser face and retracted 5 inches therefrom between each successive rotation.

If required, different portions of the condenser face may be cleaned selectively.

There is a drop in pressure from the condenser inlet to the condenser outlet on the remote side of the condenser. This pressure drop increases with the accumulation of trash. The pressure may be about 6 psi above atmospheric pressure at the inlet of the river water and about 4 psi above atmospheric pressure at the outlet on the remote side of the condenser. This pressure drop pulls the trash against the condenser face. When the valve is open for backflushing, the trash is pulled away from the condenser face and back through the shaft in a stream of water to outlet basket 32, at atmospheric pressure, to keep the condenser face clean and the pressure differential across the condenser substantially constant. This is important because if the trash is allowed to accumulate, the differential pressure between the inlet and outlet is increased and more power is required to pump the water through the condenser tubes, resulting in an increase in the electrical energy used.

Algae, crustaceans and scale may also build up on the condenser face and/or in the condenser tubes. According to prior known methods, the circulating pump for the cooling water must be turned off to clean the condenser face. Cleaning may require as long as three weeks or more for a typical large condenser having 12,000 to 15,000 tubes to be cleaned. Each tube must be individually cleaned by pressure washing and/or brushing. Cleaning is necessary when the cost of increased energy requirements due to partially clogged condenser tubes exceeds the cost of closing the equipment for cleaning. Such known cleaning methods may use chlorine or chlorine compound containing fluids for removal of crustaceans, algae and/or scale.

According to the invention, a pump, such as pump 84 (shown schematically in FIG. 1) may be provided in shaft 10. A suitable pump and associated equipment 84 for injecting and circulating fluids is known to those skilled in the art. Pump 84 is used for injection and circulation of cleaning fluids, such as chemical and/or biocidal solutions, which are pumped to the condenser face and/or through the condenser tubes for cleaning sediment, scale, algae and/or crustaceans from the condenser face and tubes. This cleaning method is fast and economical. In a preferred cleaning method, the cleaning fluid is injected while the system is operating and the plant does not need to be shut down for cleaning. Also, the environmental impact of cleaning is greatly reduced by injecting the cleaning fluids during operation of the system as the cleaning fluid is diluted with the river water immediately after passing through the tubes. If the plant needs to be shut down while chemical cleaning takes place, the circulating pump only needs to be shut down for 12 to 24 hours. The system described enables cleaning at a low monetary cost, little environmental impact and little loss of continuity of operation.

In another embodiment, the cleaning fluid may be an abrasive-containing fluid in place of, or in addition to, the chemical cleaning fluid described above. This method can also be used while the plant is operating, as discussed above. Abrasives such as sand, fine gravel, plastic beads or other material known in the art, may be injected into pump 84 and circulated to the condenser face and through the condenser tubes as discussed above. In this embodiment, the condenser face and tubes are cleaned of scale etc., abrasively. The environmental impact is low or zero when abrasive cleaning is carried out using sand or gravel, particularly when the cleaning process is carried out while the cooling water is circulating.

The apparatus and method described is time-saving since the condenser does not need to be shut-down for long periods during periodic cleaning and energy-saving due to the lack of accumulation of trash, including algae etc. on the condenser face and/or in the condenser tubes.

If a condenser is shut down for a period of time, without cooling water circulating through the condenser tubes, the condenser can become damaged or corroded from humid air in the tubes or other problems may occur with disuse. To prevent damage, corrosion, build-up of rust or other problems, the system using the rotating wand of the invention can be left running when the cooling water circulating pump is shut-down, i.e. without cooling water being circulated through the condenser. Air, preferably dehumidified air, can then be circulated through the pump and through the condenser tubes to keep the condenser dry and clean. In this embodiment, the wand is rotated, as described above, and air is pumped forward through the shaft and through the condenser by a pump 84. A pump and associated equipment for injecting dehumidified air and pumping it forward through the system is known to those skilled in the art.

While the invention has been described above with respect to certain embodiments thereof, it will be appreciated that variations and modifications may be made without departing from the spirit and scope of the invention.

What is claimed is:

1. A condenser backflush system comprising:

a hollow wand for removing trash from a face of a condenser cooled with a stream of water;

a hollow shaft attached to said hollow wand for conveying the trash to a remote location;

means for angularly rotating said wand;

means for extending said wand to adjacent the condenser face;

valve means for opening when said wand is extended adjacent the condenser face to allow trash on the condenser face to be carried by the stream of water to a remote location, and for closing before moving said wand to a different position;

means for retracting said wand from adjacent the condenser face;

control means for successively rotating said wand, extending said wand to adjacent the condenser face, opening said valve means, closing said valve means, and retracting said wand from the condenser face.

2. A condenser backflush system according to claim 1 wherein said rotating means comprises means for disengaging a rotation mechanism, means for setting an angle of rotation and means for re-engaging the rotation mechanism.

3. A condenser backflush system according to claim 1 wherein said rotating means comprises means for rotating said wand in increments of about 5° to 15°.

4. A condenser backflush system according to claim 3 wherein said rotating means comprises means for rotating said wand in increments of about 9° to 11°.

5. A condenser backflush system according to claim 1 wherein said wand comprises an elongated, hollow semicylindrical member, closed at each end.

6. A condenser backflush system according to claim 5 wherein said hollow shaft comprises a hollow pipe connected to said hollow wand.

7. A condenser backflush system according to claim 6 wherein said hollow shaft is connected to a midpoint of said hollow wand.

8. A condenser backflush system according to claim 7 wherein said hollow wand extends substantially perpendicularly to said hollow shaft.

9. A condenser backflush system according to claim 1 wherein said control means is operated automatically.

10. A condenser backflush system according to claim 1 further comprising a pump communicating with said hollow shaft for pumping fluid for cleaning said condenser face.

11. A condenser backflush system according to claim 1 further comprising a pump communicating with said hollow shaft for pumping fluid for cleaning tubes of said condenser.

12. A method for cleaning trash from a face of a condenser cooled with a stream of water, comprising:

(a) providing a hollow wand having an elongated open face in a first position adjacent the condenser face in fluid connection with a hollow shaft attached to the wand;

(b) opening an outlet valve of the shaft for enabling trash adhering to the condenser face to pass in a stream of water from adjacent the condenser face back through the hollow wand and through the hollow shaft to a remote location;

(c) closing the valve;

(d) retracting the wand from adjacent the condenser face;

(e) angularly rotating the wand;

(f) extending the wand to a second position adjacent the condenser face angularly rotated from the first position, and (g) successively repeating steps (a), (b), (c), (d), (e) and (f);

whereby the wand is rotated around the condenser face and segments of the condenser face are successively cleaned of trash.

13. A method according to claim 12 further comprising closing the outlet valve before retracting the wand.

14. A method according to claim 13 wherein the rotating step comprises:

disengaging a rotation mechanism;

resetting the rotation mechanism; and reengaging the rotation mechanism.

15. A method according to claim 12 comprising rotating the wand in increments of about 5° to 15°.

16. A method according to claim 15 comprising rotating the wand in increments of about 9° to 11°.

17. A method according to claim 12 comprising successively retracting and extending the wand about 3 to 8 inches.

18. A method according to claim 17 comprising successively retracting and extending the wand about 4 to 6 inches.

19. A method according to claim 12 further comprising separating the trash from the stream of water carrying the trash at the remote location.

20. A method according to claim 12 further comprising automatic control means for cyclically rotating the wand around the condenser face.

21. A method according to claim 12 further comprising pumping chemical cleaning fluid through the shaft to the condenser, for cleaning thereof.

22. A method according to claim 21 wherein the chemical cleaning fluid comprises biocidal cleaning compounds.

23. A method according to claim 12 further comprising pumping abrasive-containing fluid through the shaft to the condenser for cleaning the condenser face and tubes.

24. A method for maintaining a condenser in dry condition when a circulating pump for circulating cooling water through the condenser is shut down, comprising:

(a) providing a hollow wand having an elongated open face in a first position adjacent the condenser face in fluid connection with a hollow shaft attached to the wand;

(b) opening a valve of the shaft and pumping air forward through the shaft and through the condenser;

(c) closing the valve;

(d) retracting the wand from adjacent the condenser face;

(e) angularly rotating the wand;

(f) extending the wand to a second position adjacent the condenser face angularly rotated from the first position, and (g) successively repeating steps (a), (b), (c), (d) and (e);

whereby the wand is rotated around the condenser face for pumping air through the condenser.

25. A method according to claim 24 comprising pumping dehumidified air through the condenser.

* * * * *